US005810101A

United States Patent [19]

Caraway, Jr. et al.

[11] Patent Number: 5,810,101

[45] Date of Patent: Sep. 22, 1998

[54] HORIZONTAL DRILLING MACHINE

[75] Inventors: John Caraway, Jr.; George McMillan, both of Odessa, Tex.

[73] Assignee: Engineering Crossing Systems, (Partnership), Odessa, Tex.

[21] Appl. No.: 712,300

[22] Filed: Sep. 11, 1996

[51] Int. Cl.[6] ..... E21B 7/02

[52] U.S. Cl. ..... 175/78; 173/29; 173/46; 173/185; 175/87; 175/162

[58] Field of Search ..... 175/78, 87, 122, 175/162; 173/29, 46, 27, 185

[56] References Cited

U.S. PATENT DOCUMENTS

| | | | |
|---|---|---|---|
| 2,665,117 | 1/1954 | Ivey | 175/62 |
| 2,752,122 | 6/1956 | Hyah et al. | 175/122 |
| 2,859,014 | 11/1958 | Berner | 173/24 |
| 2,969,844 | 1/1961 | Hamrick | 175/62 X |
| 3,107,738 | 10/1963 | Osborn | 175/62 |
| 3,107,741 | 10/1963 | Adams | 175/62 |
| 3,113,628 | 12/1963 | Orcutt | 405/184 |
| 3,118,509 | 1/1964 | Adams et al. | 175/62 |
| 3,757,875 | 9/1973 | Gunning | 173/46 X |
| 4,124,082 | 11/1978 | Garver | 175/62 |
| 4,199,033 | 4/1980 | Van Gundy, Jr. | 173/27 |
| 4,368,873 | 1/1983 | Perry | 254/29 |
| 4,417,628 | 11/1983 | Gessner | 173/29 |
| 4,553,612 | 11/1985 | Durham | 175/122 |
| 4,691,788 | 9/1987 | Yoshida et al. | 175/62 |
| 4,898,251 | 2/1990 | Clark et al. | 175/27 |
| 4,938,296 | 7/1990 | Brazell, II | 173/185 |
| 4,976,321 | 12/1990 | Van Meter | 175/24 |
| 4,998,590 | 3/1991 | Wells | 175/162 |
| 5,288,173 | 2/1994 | Jenne et al. | 405/184 |
| 5,377,767 | 1/1995 | Briggs | 173/185 X |

FOREIGN PATENT DOCUMENTS

| | | | |
|---|---|---|---|
| 1773274 | 10/1992 | Russian Federation | 175/162 |

OTHER PUBLICATIONS

Author—Production Diggers, Inc. a Sales Brouchure, Title—Production Diggers, Inc. a Sales Brouchure Date Estimate 1996 a Sales Brochure.

*Primary Examiner*—Hoang C. Dang
*Attorney, Agent, or Firm*—Wendell Coffee

[57] ABSTRACT

A digger from a unit for digging utility pole holes is encased in an elongated box. The box has an attachment thereon for attachment to the carrying arm of a backhoe in place of the backhoe bucket. A 90° attachment provides versatility. The digger is thus capable of digging horizontal tunnels for laying one underground line under another underground line.

8 Claims, 3 Drawing Sheets

HORIZONTAL DRILLING MACHINE

BACKGROUND OF THE INVENTION (1) Field of the Invention

This invention is related to laying lines such as pipelines and more particularly to tunneling under an existing line when laying a new line which crosses the existing line.

Pipeline contractors have ordinary skill in this art.

(2) Description of the Related Art

One of the difficulties in laying underground lines is crossing other underground lines. As used herein the term "line" is used broadly to include (1) pipelines such as lines used to carry liquids such as water and petroleum liquids or to be carrying gases such as natural gas or carbon dioxide, or (2) electrical power lines, or (3) communication lines such as wire telephone cables, or fiberoptic cables. Also it is to be understood that pipelines could be steel, concrete, or composition materials.

The standard procedure, at the present time, when laying a new line which crosses an existing line is that the owner of the existing line sends a representative to the crossing location. Then the pipeline contractor hand digs to the top of the existing line. At that time the representative for the existing line can inform the contractor as to the diameter of the line. Therefore from the elevation of the top of the line, the location of the bottom of that line can be determined. Normal practice is to have the new line vertically separated from the old line by at least two feet.

The practice is for there to be no mechanical operation within two feet of the existing line. Therefore the ditch is dug by a trencher or backhoe to a horizontal distance of two feet of the existing line and to a depth below the bottom of the existing line. By normal practice the depth of the ditch or trench would be at least two feet plus the diameter of the new line below the existing line. Then a tunnel would be hand dug from one side of the existing ditch to the other. As soon as the tunnel is finished, the process of laying the new line would proceed.

It will be understood that if the existing line carries a flammable or toxic fluid, those people hand digging the tunnel beneath the existing line are in danger. Regardless of the care taken there is always possibility of rupturing the existing line.

Also, the majority of the mechanical devices require an operator to operate the device within the ditch. Such a device is disclosed in J. D. Osborne U.S. Pat. No. 3,107,738.

Many patents have been issued for tunneling under objects to lay lines. Most of the patents have been issued for digging under paved roadways. Some, such as Jenne et al. U.S. Pat. No. 5,288,173 have been for the purpose of tunneling under existing lines.

Also in another art, other diggers have been developed, particularly in the art of digging holes for poles such as utility poles. These are self-contained units which are designed to dig vertical holes more than about 18" inches in diameter and more than about 6' feet deep for utility poles. Such a product is manufacturing and sold by Production Drillings, Inc. of Wichita Falls, Tex. These units include a mechanism which has a rotor and a kelly-bar. The kelly-bar extends slidably through a rotating mechanism which causes the kelly-bar to rotate. A pusher cylinder pushes the kelly-bar downward. A bit to dig a hole is on the kelly-bar. These units are mounted on a truck so they can be readily erected and operated by operators standing beside the unit to manipulate the downward pressure and rotation to dig a hole to the desired depth.

Such units are commercially available upon the market.

SUMMARY OF THE INVENTION (1) Progressive Contribution to the Art

This invention utilizes the diggers previously used for digging vertical holes. The digger is securely encased in a rectangular parallelepiped box. An attachment box is attached to the digger box. The attachment box is provided with pins which are designed to fit and be connected to a carrying arm of a conventional backhoe. As used herein the term "backhoe" is meant to include a vehicle with either a track laying mechanism or rubber tired wheels together with a carrying arm which includes a boom and a dipper stick with links. The dipper stick and links connect the carrying arm to a bucket. For the purpose of this invention the bucket is removed and the carrying arm is connected to the pins of the attachment box the same as though it were a bucket.

In such a direct attachment the center line of the digger within the digger box would be aligned with the carrying arm. If the carrying arm extended directly in line with the backhoe vehicle itself; the backhoe could straddle the trench and the digger box could be lowered into the trench and aligned with the ditch. Then with the regular controls for the digger on the top of the ground, the operator could extend the drilling bit against the face of the ditch and tunnel beneath the existing line in a horizontal direction.

A ninety degree attachment provides an alternate approach. The ninety degree attachment includes a second set of pins, which when attached to the attachment box would be at right angles to the pins upon the attachment box. Therefore when the ninety degree attachment was used, the digger box would be at right angles to the carrying arm. With the carrying arm behind the backhoe, the backhoe could be at right angles to the ditch and the digger box aligned with the ditch. If the carrying arm were placed at right angles to the direction of travel of the backhoe then the digger box could be aligned with the ditch with the backhoe positioned along side and parallel to the ditch.

(2) Objects of this Invention

An object of this invention is to lay a new line crossing an existing line. More specifically the object of this invention is to tunnel under an existing line to lay such a new line.

Still further objects are to perform the above without the necessity of workman or operators being in the ditch at the time when the tunnel is dug under an existing line.

Further objects are to achieve the above with devices that are sturdy, compact, durable, lightweight, simple, safe, efficient, versatile, ecologically compatible, energy conserving, and reliable, yet inexpensive and easy to manufacture, attach, operate, and maintain.

Other objects are to achieve the above with a method that is rapid, versatile, ecologically compatible, energy conserving, efficient, and inexpensive, and does not require highly skilled people to attach, operate, and maintain.

The specific nature of the invention, as well as other objects, uses, and advantages thereof, will clearly appear from the following description and from the accompanying drawings, the different views of which are not necessarily scale drawings.

Figure 1:
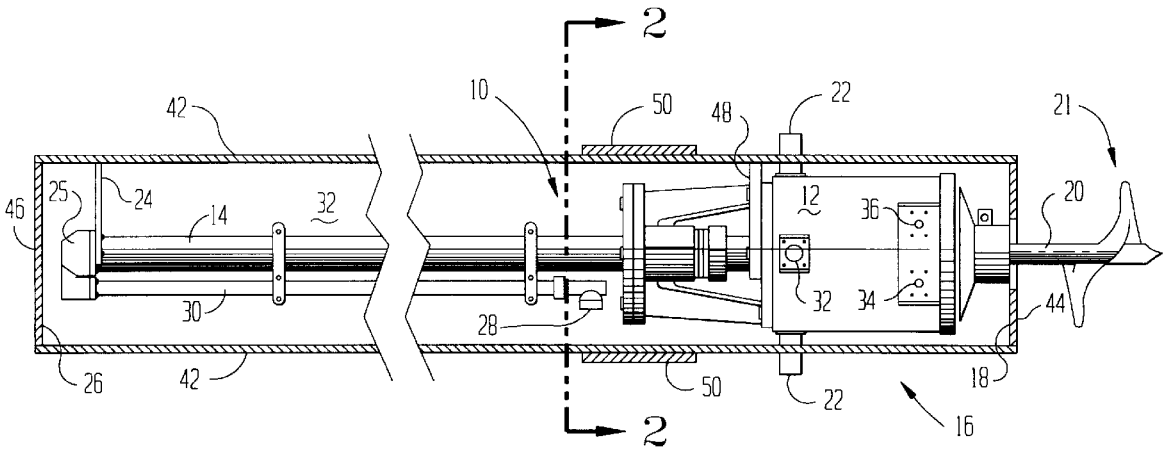
FIG. 1 is a view of a digger as used in this invention is encased in a digger box with the digger box in section taken on line 1—1 of FIG. 2.

As an aid to correlating the terms of the claims to the exemplary drawing(s), the following catalog of elements and steps is provided:

CATALOG OF ELEMENTS

10 digger
12 drive mechanism
14 feed ram housing
16 box, digger
18 drill end
20 kelly-bar
21 bit
22 trunnions
24 mounting plate
25 feed ram cap
26 push end
28 push valve port
30 hydraulic trans
32 port
34 port
36 port
38 bottom panel
40 top panel
43 side panel
44 drill end plate
46 push end plate
48 mounting plate
50 attach plate
52 attach box
54 box braces
56 attach pins
58 dipper stick
60 carry arm
61 link
62 backhoe
64 ditch
66 source of hydraulic pressure
68 control box
70 hoses
72 90° end plates
74 aperture, front
76 aperture, back
78 90° attachment

DESCRIPTION OF THE PREFERRED EMBODIMENTS(S)

Referring to FIG. 1 there may be seen a cross section of a box 16 with a digger 10 therein. The digger would include a motor and rotary drive member or mechanism 12. A feed ram housing 14 is connected to the rotating mechanism. A kelly-bar 20 extending from the drive mechanism projects from the digger box 16 at a drill end 18. Bit 21 is on the distal end of the kelly-bar 20.

Trunnions 22 attached to the drive mechanism provided 10 are used when the digger 10 was to be mounted vertically on a truck. A mounting plate 24 is attached to a feed ram cap 25 which is adjacent to push end 26 of the box 16. Push valve port 28 is connected to a hydraulic transfer tube 30 which extends from the feed ram cap to the port 28. Ports 32, 34, and 36 are mounted upon is the housing of the drive mechanism 12.

The box 16 includes bottom rectangular panel 38 which is parallel to the top rectangular panel 40. The side panels 42 lay in planes normal to the top and bottom panels. Drill end plate 44 at the drill end 18 is normal to both the top and the side plates. The plate 44 has an opening to permit the kelly-bar 20 to extend therefrom. Push end plate 46 is at the push end 26 and is parallel to the drill end plate. The side panels, bottom panel, and two end plates can all be welded together to form a secure box. They can also be connected by angle clips and bolts if such a construction is preferred. The kelly-bar will be parallel to the top and bottom plates as well as to the two side plates. The top plate 40 is bolted to the side plates 42 and the end plates to provide access to the digger. Sufficient holes is provided through the top plate to connect the hydraulic lines to the ports 28, 32, 34, and 36.

The digger 10 will be securely attached within the digger box 16. Particularly the trunnions 22 will be fastened securely in place either to the bottom or to the side plates. The mounting plate 24 connects to the feed ram cap also is connected to the box sides or bottom. Mounting plate 48 connects the drive mechanism 12 to the bottom panel 38 and side panels 42. Those having ordinary skill in the pipeline art have the necessary skill to securely mount the digger within the digger box.

Attachment plates 50 are secured to the side panels 42. These plates may either be bolted in place or preferably welded in place. The attachment plates will extend above the top panel 40. A top portion of the two attachment plates 50 will form two sides of an attachment box 52 which will be above the top of the digger box. Box braces 54 will be attached to the attachment plates 50 at the front and back to form a rigid connection. Above the top panel 40 of the digger box 16, two attachment pins 56 are attached to the attachment plates 50. These pins will be parallel to one another and parallel to the top. They will be normal to the attachment plates and therefore also normal to the side panels 42.

Figure 6:
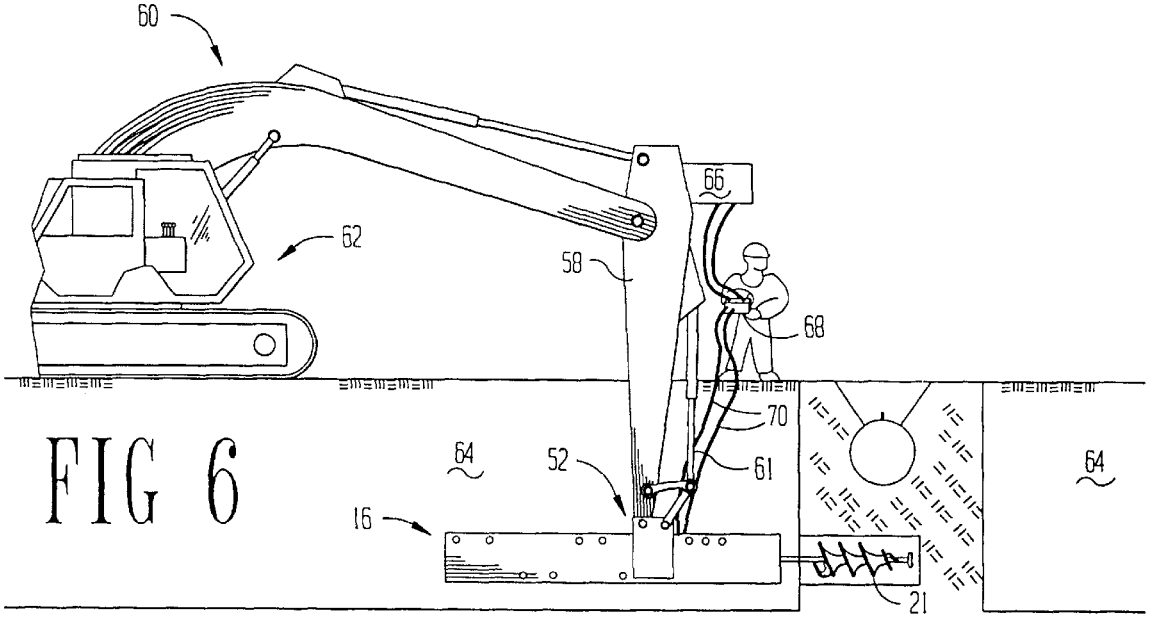
FIG. 6 is a schematic representation of a backhoe straddling the ditch with a digger operating in the ditch.

The attachment pins 56 are so designed and constructed that they correspond to the attachment pins which are otherwise upon the backhoe bucket when the backhoe is in its normal configuration. That is to say that when the backhoe bucket is disconnected from the dipper stick 58 of the carrying arm 60 of the backhoe 62 that the digger box can be attached thereto. (FIG. 6) With the digger box so attached and with the carrying arm aligned behind the backhoe and also a line in the direction of travel of the backhoe and with the backhoe straddling a ditch 64 it may be seen that the box will also be aligned with the ditch 64 and the kelly-bar likewise aligned with the ditch 64. The box can be lowered into the bottom of the ditch and securely pressed down against the bottom of the ditch by manipulation of the carrying arm. With the box pressed firmly against the bottom of the ditch it will be securely attached so that with hydraulic hoses 70 attached to a supply of hydraulic fluid under pressure 66 on the backhoe vehicle that the digger may be operated by a control box 68. As stated before the control box can be located above ground and connected to the digger by convenient hydraulic hoses 70 which are themselves attached to the ports 28, 32, 34, and 36 so that the digger can be operated.

The operation of the digger is the same as the operation of the digger when it is being used to dig vertical holes. With the digger in such a position a tunnel can be dug under the existing line without difficulty and without endangering any of the workmen on the site.

Figure 5:
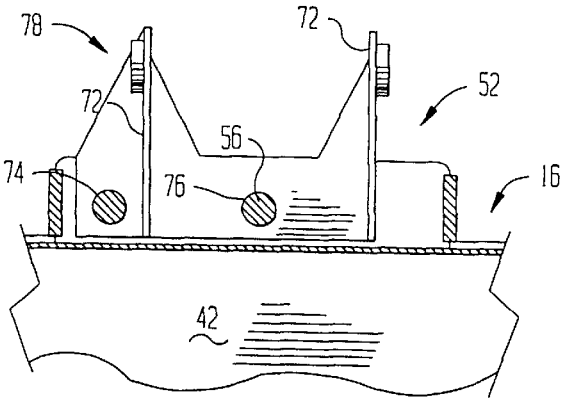
FIG. 5 is a sectional view taken on line 5—5 of FIG. 4 which is similar to FIG. 3 and shows the attachment of the 90° attachment box.
Figure 4:
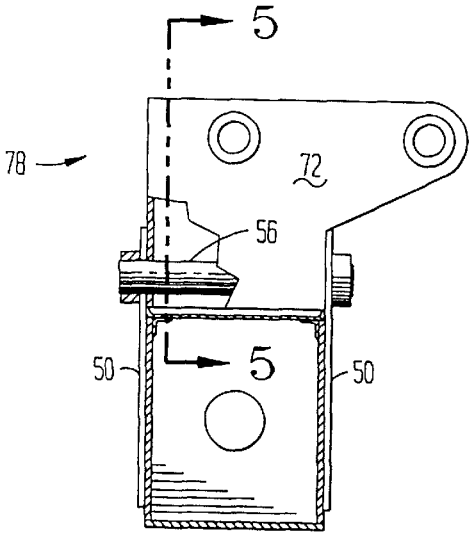
FIG. 4 is a sectional view similar to FIG. 2 showing a 90° attachment attached to the digger box.
Figure 8:
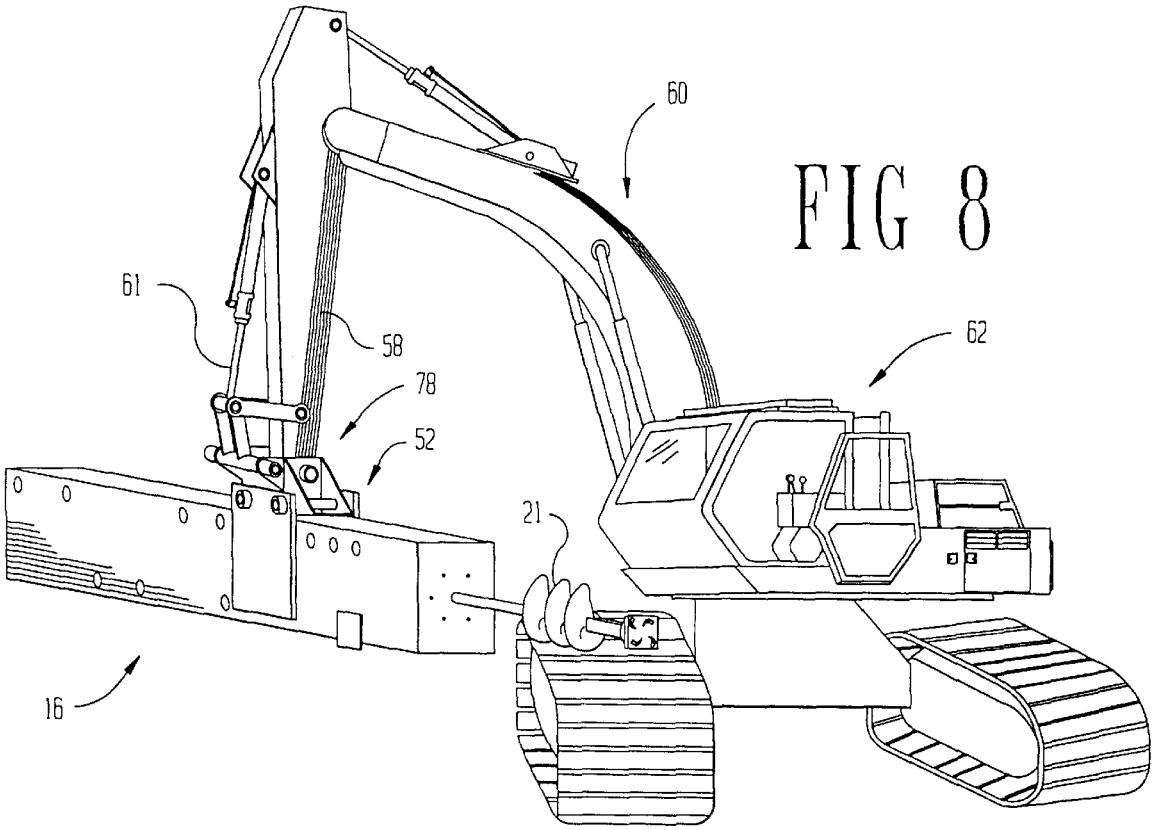
FIG. 8 is a perspective view of a backhoe with a digger attached at 90° to the carrying arm.

In the event that it is not convenient or practical to have the backhoe straddling the ditch; a ninety degree attachment 78 can be attached to the box. (FIGS. 4&5) The ninety degree attachment has two end plates 72 each of the end plates has a front aperture 74 and rear aperture 76. One of the pins of the attachment box 52 would extend through the front apertures of the end plates 72 and the other pin would extend through the two rear apertures of the end plates 72.

Figure 7:
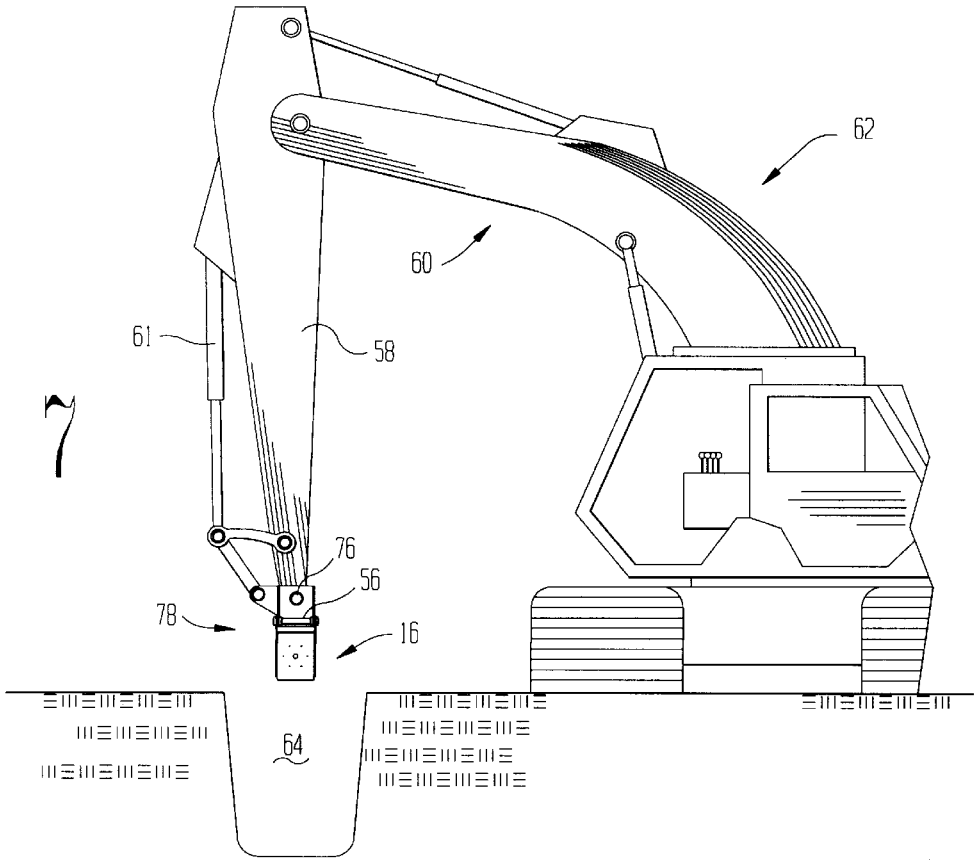
FIG. 7 is a schematic representation of a backhoe alongside of a ditch with the digger box attached at 90° above the ditch that is in position to be lowered into the ditch.
Figure 3:
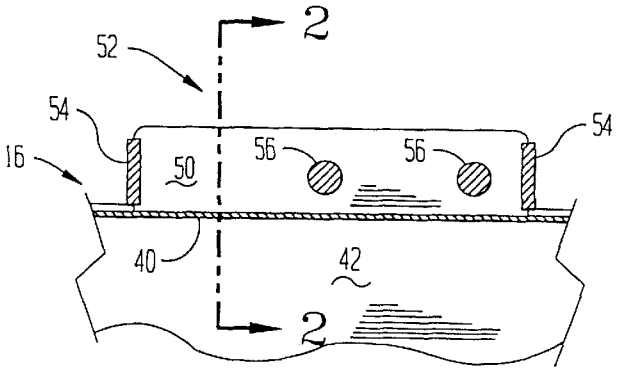
FIG. 3 is a sectional view taken on line 3—3 of FIG. 2 showing the top portion of the digger box and the attachment box.
Figure 2:
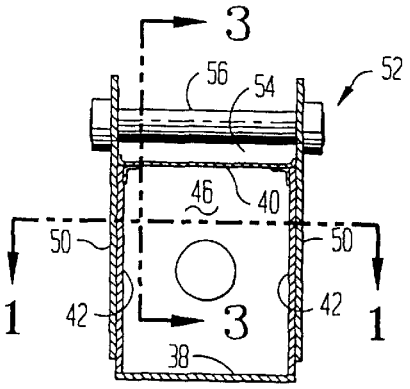
FIG. 2 is a sectional view taken along line 2—2 of FIGS. 1 & 3 showing construction of the digger box at that point.

Therefore it may be seen with the 90° attachment that it could be attached to backhoe 62 as seen in FIG. 7. That is to say in this arrangement the digger box 16 and the kelly-bar 20 would be at right angles to the carry arm 60. Therefore with the backhoe 62 at right angles to the ditch and the carry arm extending from the centerline of the backhoe that the kelly-bar would be aligned with the ditch and could be lowered into the ditch for use in that position.

The embodiment shown and described above is only exemplary.

I do not claim to have invented all the parts, elements or steps is described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

We claim as our invention:

1. A horizontal drilling machine having a) a digger which includes b) a motor drivingly connected to a rotating mechanism and a kelly-bar rotatable extending through the rotating mechanism;

wherein the improvement comprises:

c) a box having a top panel, two side panels, a push end, and a drill end and, d) said digger securely mounted in said box with e) the kelly-bar parallel to the two side panels and top panel, ee) a bit on the kelly-bar which extends through the drill end, and f) an attachment box on the top panel, g) said attachment box designed and constructed to be attached to a carrying arm of a backhoe with the kelly-bar horizontal.

2. The horizontal drilling machine as defined in claim 1 further comprising:

h) said box having a bottom panel, i) a push plate at the push end, and j) a drill plate at the drill end.

3. The structure as defined in claim 1 further comprising:

h) two pins on said attachment box above the top panel, i) said pins parallel to each other and to the top panel of the box, j) said pins normal to the side panels of the box, and k) said pins forming a part of means for attaching said box to said carrying arm.

4. The horizontal drilling machine as defined in claim 3 further comprising:

l) a ninety degree attachment having two end plates, each of said end plates having a front aperture and a rear aperture, m) one of said pins on said attachment block extending through the front apertures and another of said pins on the attachment block extending through the rear apertures, and n) two side plates on said ninety degree attachment also having two apertures in each of said side plates, o) said apertures in the side plates constructed and adapted to have pins which mate with and be attached to said carrying arm of a backhoe.

5. The structure as defined in claim 1 further comprising:

h) hydraulic hoses attached to said digger and extending above ground and i) a source of hydraulic fluid under pressure attached to said hydraulic hoses.

6. The structure as defined in claim 1 further comprising:

h) control lines connect to said digger, and i) a control box above ground connected to said control lines.

7. A horizontal drilling machine having a) a digger which includes b) a motor drivingly connected to a rotating mechanism and a kelly-bar rotatable extending through the rotating mechanism;

wherein the improvement comprises:

c) a box having a top panel, two side panels, a push end, and a drill end and, d) said digger securely mounted in said box with e) the kelly-bar parallel to the two side panels and top panel, ee) a bit on the kelly-bar which extends through the drill end, and f) an attachment box on the top panel, g) said attachment box forming means for attaching said box to a carrying arm of a backhoe with the kelly-bar horizontal.

8. The horizontal drilling machine as defined in claim 7 further comprising:

h) said box having a bottom panel, a push plate at the push end, and a drilling plate at the drilling end, i) two pins on said attachment box above the top panel, j) said pins parallel to each other and to the top panel of the box, k) said pins normal to said side panels of the box, l) said pins forming a part of said means for attaching the box to the carrying arm, m) a 90° attachment having two end plates, n) each of said end plates having a front aperture and a rear aperture, o) one of said pins in said attachment box extending through each front aperture and another of said pins on the attachment box extending through each rear aperture, p) two side plates on said 90° attachment also having two apertures in each side plate, q) said apertures in side plates mated with and attached to said carrying arm of the backhoe, r) hydraulic lines attached to said digger and extending above the ground, s) a source of hydraulic fluid on said backhoe attached to said hydraulic hoses, t) control lines connected to said digger, and u) a control box above ground connected to said control lines.

* * * * *